US005866977A

United States Patent [19]

Lee et al.

[11] Patent Number: 5,866,977

[45] Date of Patent: Feb. 2, 1999

[54] PHOSPHOR SCREEN WITH DOUBLE LAYERED BLUE PHOSPHOR AND METHOD THEREOF

[75] Inventors: Joon Bae Lee; Chang Won Park; Jae Woo Bae, all of Kyungki-do, Rep. of Korea

[73] Assignee: Samsung Display Devices Co., Ltd., Kyungki-do, Rep. of Korea

[21] Appl. No.: 867,710

[22] Filed: Jun. 2, 1997

[30] Foreign Application Priority Data

Dec. 3, 1996 [KR] Rep. of Korea ..... 96-61376

[51] Int. Cl.[6] ..... H01J 29/10

[52] U.S. Cl. ..... 313/463; 313/461; 313/473

[58] Field of Search ..... 313/461, 463, 313/467, 473

*Primary Examiner*—Vip Patel

*Attorney, Agent, or Firm*—Christie, Parker & Hale, LLP

[57] ABSTRACT

A double layer phosphor screen comprising a panel having black matrix for a CRT and red, green and blue phosphors on the panel, wherein the phosphor is formed on which the black matrix is not formed and the blue phosphor is formed in double layers, and the CIE Y color coordinate of the blue phosphor for a first layer formed on the panel is 0.045 to 0.065, the CIE Y color coordinate of the blue phosphor for a second layer formed on the first layer is 0.075 to 0.095, improves brightness, color reproducing range and contrast.

8 Claims, 2 Drawing Sheets

PHOSPHOR SCREEN WITH DOUBLE LAYERED BLUE PHOSPHOR AND METHOD THEREOF

(1) FIELD OF THE INVENTION

The present invention relates to a double layer phosphor screen and a process for preparing the same, particularly to a phosphor screen including a double layer of blue phosphor. The phosphor screen of the present invention shows preferable brightness, contrast and color reproducing range.

(2) DESCRIPTION OF THE RELATED ART

In a conventional shadow-mask-type CRT (cathode ray tube), graphic images are reproduced by red, green, and blue electron beams emitted from means for producing them which pass through a hole of a shadow mask, converge into a point, and collide with red, green, and blue phosphors formed on a phosphor screen of an inner surface of a panel.

The phosphor screen comprises red, green, and blue phosphors which have a pattern and black matrix which is formed on the same surface and between the phosphors.

Generally, a process for forming a phosphor screen takes the following steps.

A photoresist is coated on the inner surface of a panel, dried by heat or other means, and exposed by irradiation of ultraviolet rays through mask slots. The exposed panel is washed and developed to remove the unexposed photoresist and then dried. Black matrix materials are coated on the panel on which the photoresist-coated portion and photoresist-uncoated portion are regularly arranged. Then, the black matrix is produced by etching the panel. A phosphor screen is produced by using red, green and blue phosphors and then deposing an aluminum film on the panel having the black matrix.

Brightness, color reproducing range and contrast have immense effect on the graphic image of a CRT. So continuous efforts to improve brightness of a CRT by increasing fluorescent intensity to electron beams and to improve contrast of a CRT by magnify reflection ratio to exterior lights have been performed.

Meanwhile, ZnS;AgAl, ZnS;AgCl, etc. are generally used as blue phosphor materials of the CRT. As shown in FIG. 3, the intensity of brightness is reversibly proportional to that of color coordinate (Y). Increasing the value of color coordinate makes the color blurred, which means that the color reproducing range decreased. Therefore, to improve the brightness and the color reproducing range at the same time is always restricted. To resolve the above problems, some people make attempts to improve brightness by adding some additives in the ZnS type blue phosphor material and improve contrast by attaching a filter to a panel. However, the above trials almost do not improve the performance of a CRT. Additionally, the attempt using a filter causes the process difficult and increase the production cost.

SUMMARY OF THE INVENTION

The present invention is to solve the above problems in the conventional arts. The present invention provides a double layer phosphor screen and a process for preparing the same which shows preferable brightness, contrast and color reproducing range.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION OF THE INVENTION

To achieve the above object, the present invention provides a double layer phosphor screen comprising a panel having black matrix for a CRT and red, green and blue phosphors on said panel, wherein the phosphor is formed on which the black matrix is not formed and said blue phosphor is formed in double layers, and the CIE Y color coordinate of the blue phosphor for a first layer formed on the panel is 0.045 to 0.065, the CIE Y color coordinate of the blue phosphor for a second layer formed on the first layer is 0.075 to 0.095.

The present invention also provides a process for preparing a double layer phosphor screen comprising the steps of forming red and green phosphor dots on a panel having black matrix for a CRT, coating the slurry of a blue phosphor for a first layer on said panel, wherein a CIE Y color coordinate of the phosphor is 0.045 to 0.065, coating the slurry of a blue phosphor for a second layer on said first layer, wherein a CIE Y color coordinate of the phosphor is 0.075 to 0.095, and forming a double layer blue phosphor dots by exposing and developing the slurry of the blue phosphor for said first and second layers.

It is preferable that said blue phosphor for said first layer has a diameter of 5 to 10 $\mu$m and pigments are attached to it. It is also preferable that said blue phosphor for said second layer has not pigments and the ratio of the thickness of said first layer to said second layer is 1:2.

DETAILED DESCRIPTION OF THE PREFERRED EMBODIMENTS

REPRESENTATIVE EXAMPLES

Figure 2:
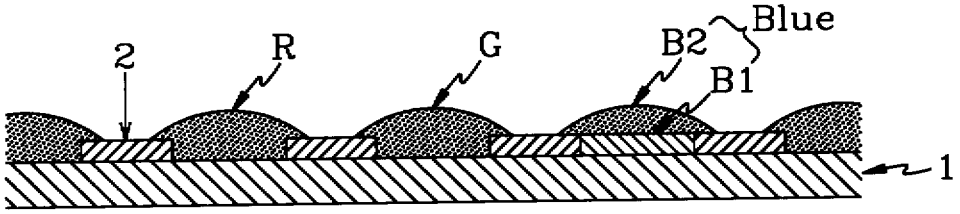
FIG. 2 is a cross sectional view of a phosphor screen having red, green and blue phosphors having double layers on a black matrix-coated panel according to the present invention.
Figure 3:
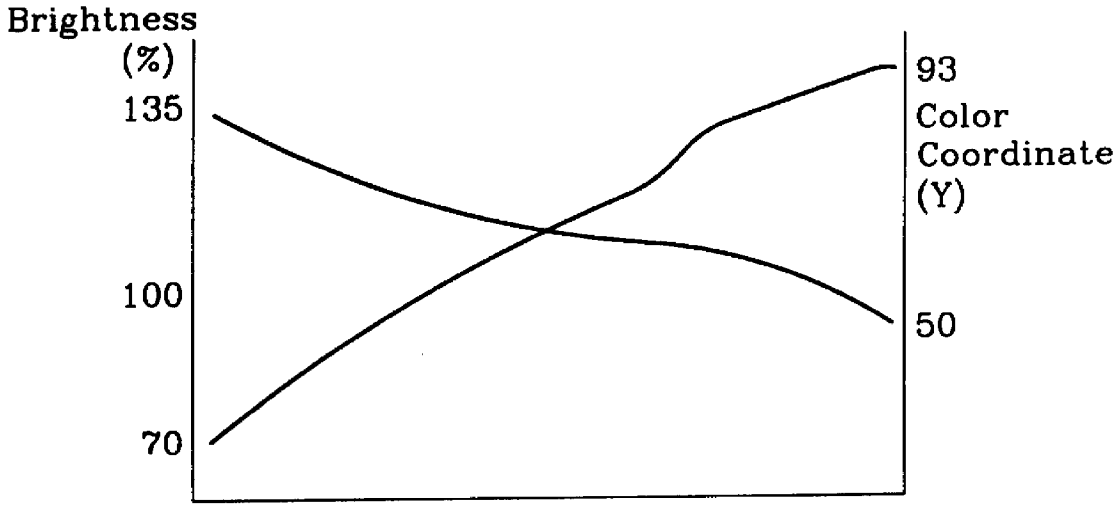
FIG. 3 is a graph showing relations between brightness and color coordinate.

As shown in FIG. 2, red phosphor dots (R) and green phosphor dots (G) are formed on a panel (1) having black matrix dots (2) for a CRT according to a conventional process. After the red and green phosphors are formed, a blue phosphor slurry (B1) which has pigments and has 0.045 to 0.065 of CIE Y color coordinate is coated on the panel. Thereafter, a blue phosphor slurry (B2) which has 0.075 to 0.095 of CIE Y color coordinate is coated on the blue phosphor slurry (B1). Then, these two layer of blue phosphor slurry are exposed and developed to produce a blue phosphor having a double layer. Conventional coating methods like a spin coating or a roll coating can be used in the above process. It is preferable that the ratio of thickness of the layer (B1) to the layer (B2) is 1:2. The phosphor screen of the present invention is produced by deposing an aluminum film on the panel on which the above red, green and blue phosphors are formed.

PREFERABLE EXAMPLES

A preferable working example and reference examples are described below. These examples are exemplary only, and the present invention is not restricted to the scope of the example.

WORKING EXAMPLE 1

PVP-DAS, a photoresist is evenly coated with 1 m thickness on the surface of a 14 inch panel for a CRT, exposed by a super high voltage Hg-lamp having wavelength of 250–600 nm of ultraviolet rays for 20 seconds. The exposed panel was washed with pure water, developed and dried at 25° C. for 3 minutes to produce photoresist dots. Graphite generally used as black matrix material was coated on the panel. Then the panel was exposed, developed and washed to produce black matrix dots.

Small amount of a surfactant and a dispersion agent were added to red phosphor material to produce a slurry. The slurry was coated on the panel, dried, exposed by a super high voltage Hg-lamp and developed with water under a low pressure to produce red phosphor dots. To produce green phosphor dots, the above process was performed with the same manner. After the red and green phosphor dots were formed, a blue phosphor slurry (B1) which has pigments and has 0.055 of CIE Y color coordinate was coated with 10 $\mu$m thickness on the panel. Thereafter, a blue phosphor slurry (B2) which has 0.093 of CIE Y color coordinate was coated with 20 $\mu$m thickness on the blue phosphor slurry (B1). Then, these two layers of blue phosphor slurry were exposed and developed to produce a blue phosphor having a double layer. The phosphor screen of the present invention was produced by deposing an aluminum film on the panel on which the above red, green and blue phosphors were formed.

REFERENCE EXAMPLE I

Figure 1:
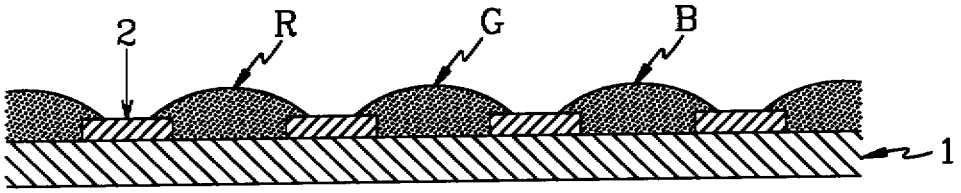
FIG.1 (Prior Art)
FIG. 1 is a cross sectional view of a prior phosphor screen having red, green and blue phosphors on a black matrix-coated panel.

As shown in FIG. 1, PVP-DAS, a photoresist is evenly coated with 1 $\mu$m thickness on the surface of a 14 inch panel (1) for a CRT, exposed by a super high voltage Hg-lamp having wavelength of 250–600 nm of ultraviolet rays for 20 seconds. The exposed panel was washed with pure water, developed and dried at 25° C. for 3 minutes to produce photoresist dots. Graphite generally used as black matrix material was coated on the panel. Then the panel was exposed, developed and washed to produce black matrix dots (2).

Small amount of a surfactant and a dispersion agent were added to red phosphor material to produce a slurry. The slurry was coated on the panel, dried, exposed by a super high voltage Hg-lamp and developed with water under a low pressure to produce red phosphor dots (R). To produce green phosphor dots (G), the above process was performed with the same manner. After the red and green phosphor dots were formed, a blue phosphor slurry (B) which has 0.066 of CIE Y color coordinate was coated with 10 $\mu$m thickness on the panel. Thereafter, the layer of blue phosphor slurry were exposed and developed to produce a blue phosphor. The phosphor screen was produced by deposing an aluminum film on the panel on which the above red, green and blue phosphors were formed.

REFERENCE EXAMPLE 2

PVP-DAS, a photoresist is evenly coated with 1 $\mu$m thickness on the surface of a 14 inch panel for a CRT, exposed by a super high voltage Hg-lamp having wavelength of 250–600 nm of ultraviolet rays for 20 seconds. The exposed panel was washed with pure water, developed and dried at 25° C. for 3 minutes to produce photoresist dots. Graphite generally used as black matrix material was coated on the panel. Then the panel was exposed, developed and washed to produce black matrix dots.

Small amount of a surfactant and a dispersion agent were added to red phosphor material to produce a slurry. The slurry was coated on the panel, dried, exposed by a super high voltage Hg-lamp and developed with water under a low pressure to produce red phosphor dots. To produce green phosphor dots, the above process was performed with the same manner. After the red and green phosphor dots were formed, a blue phosphor slurry which has 0.093 of CIE Y color coordinate was coated with 10 $\mu$m thickness on the panel. Thereafter, a blue phosphor slurry which has pigments and has 0.055 of CIE Y color coordinate was coated with 20 $\mu$m thickness on the blue phosphor slurry. Then, these two layers of blue phosphor slurry were exposed and developed to produce a blue phosphor having a double layer. The phosphor screen was produced by deposing an aluminum film on the panel on which the above red, green and blue phosphors were formed.

REFERENCE EXAMPLE 3

As shown in FIG. 1, PVP-DAS, a photoresist is evenly coated with 1 $\mu$m thickness on the surface of a 14 inch panel (1) for a CRT, exposed by a super high voltage Hg-lamp having wavelength of 250–600 nm of ultraviolet rays for 20 seconds. The exposed panel was washed with pure water, developed and dried at 25° C. for 3 minutes to produce photoresist dots. Graphite generally used as black matrix material was coated on the panel. Then the panel was exposed, developed and washed to produce black matrix dots (2).

Small amount of a surfactant and a dispersion agent were added to red phosphor material to produce a slurry. The slurry was coated on the panel, dried, exposed by a super high voltage Hg-lamp and developed with water under a low pressure to produce red phosphor dots (R). To produce green phosphor dots (G), the above process was performed with the same manner. After the red and green phosphor dots were formed, a blue phosphor slurry which has 0.093 of CIE Y color coordinate and a blue phosphor slurry which has 0.055 of CIE Y color coordinate were mixed and coated with 10 $\mu$m thickness on the panel. Thereafter, the layer of blue phosphor slurry were exposed and developed to produce a blue phosphor. The phosphor screen was produced by deposing an aluminum film on the panel on which the above red, green and blue phosphors were formed.

Brightness and phosphor reflection ratio (contrast) of CRTs using the phosphor screens produced with the above examples were tested by a photometer (Minolta CA-100) and the results are shown in Table 1.

TABLE 1

| | CIE Y color coordinate | Brightness (%) | Phosphor reflection ratio |
|---|---|---|---|
| Work. Exam. 1 | 1'st layer phosphor 0.055<br>2'nd layer phosphor 0.093 | 121 | 115 |
| Ref. Exam. 1 | 0.066 | 100 | 100 |
| Ref. Exam. 2 | 1'st layer phosphor 0.093<br>2'nd layer phosphor 0.055 | 113 | 85 |
| Ref. Exam. 3 | mixed | 102 | 95 |

As shown in Table 1, brightness of the double layer phosphor screen of the present invention increased about 20% compared with that of Reference Example 1 and the phosphor reflection ratio increased about 15% compared with that. A CRT having smaller dots can be achieved by the present invention because high contrast makes a fluorescent area decreased. Therefore, we can assume that a CRT of the present invention can be used as a HDTV and so on.

What is claimed is:

1. A double layer phosphor screen comprising:

a panel having black matrix for a CRT; and red, green and blue phosphors on said panel, wherein the phosphor is formed on which the black matrix is not formed and said blue phosphor is formed in double layers, and the CIE Y color coordinate of said blue phosphor for a first layer formed on the panel is 0.045 to 0.065, the CIE Y color coordinate of said blue phosphor for a second layer formed on the first layer is 0.075 to 0.095.

2. The phosphor screen as claimed in claim 1, wherein said blue phosphor for said first layer has a diameter of 5 to 10 $\mu$m and pigments are attached to it.

3. The phosphor screen as claimed in claim 1, wherein said blue phosphor for said second layer has no pigments.

4. The phosphor screen as claimed in claim 1, wherein the ratio of the thickness of said first layer to said second layer is 1:2.

5. A process for preparing a double layer phosphor screen comprising the steps of:

forming red and green phosphor dots on a panel having black matrix for a CRT;

coating the slurry of a blue phosphor for a first layer on said panel, wherein a CIE Y color coordinate of the phosphor is 0.045 to 0.065;

coating the slurry of a blue phosphor for a second layer on said first layer, wherein CIE Y color coordinate of the phosphor is 0.075 to 0.095; and forming double layer blue phosphor dots by exposing and developing the slurry of blue phosphor for said first and second layers.

6. The process as claimed in claim 5, wherein said blue phosphor for said first layer has a diameter of 5 to 10 $\mu$m and pigments are attached to it.

7. The process as claimed in claim 5, wherein said blue phosphor for said second layer has no pigments.

8. The process as claimed in claim 5, wherein the ratio of the thickness of said first layer to said second layer is 1:2.

* * * * *